United States Patent [19]

Badenhorst et al.

[11] Patent Number: 4,740,178

[45] Date of Patent: Apr. 26, 1988

[54] BATTERY TERMINAL CONNECTION APPARATUS

[75] Inventors: Carel D. Badenhorst; Nico V. Riet, of Johannesburg, South Africa

[73] Assignee: VBH Investments (Proprietary) Limited, Johannesburg, South Africa

[21] Appl. No.: 91,865

[22] Filed: Sep. 1, 1987

[51] Int. Cl.[4] ..... H01R 4/42

[52] U.S. Cl. ..... 439/758; 439/142; 439/592

[58] Field of Search ..... 439/142, 144, 592, 754, 439/757, 758, 761–766, 892

[56] References Cited

U.S. PATENT DOCUMENTS 2,531,307 11/1950 Thomas ..... 439/758
3,973,820 8/1976 Benson ..... 439/758
4,410,226 10/1983 Adduci et al. ..... 439/142
4,700,961 10/1987 Thomas et al. ..... 439/142

*Primary Examiner*—Gil Weidenfeld
*Assistant Examiner*—Paula A. Austin
*Attorney, Agent, or Firm*—Cushman, Darby & Cushman

[57] ABSTRACT

The apparatus includes a battery terminal and a connector pin. The battery terminal is formed of an electrically condustive material and has means enabling it to be connected electrically to the positive or negative post of a 12 V DC vehicle battery post. The terminal presents two sockets each of which is capable of receiving a connector pin. The connector pin has spigot portion composed of spaced prongs biased apart from one another, so that the spigot portion can be inserted as an interference fit into the chosen socket.

6 Claims, 1 Drawing Sheet

BATTERY TERMINAL CONNECTION APPARATUS

BACKGROUND TO THE INVENTION

This invention relates to a battery terminal connection apparatus.

Conventional vehicle battery terminals are connected permanently to the ends of the battery cables leading respectively to earth and to the ignition system of the vehicle. The terminal itself has a clamping arrangement whereby it can be clamped to the positive or negative post on the battery. If it is desired for some reason to disconnect the battery cables from the battery, it is necessary to go through the laborious process of unclamping the terminals from the battery posts.

The present invention seeks to provide an improved battery terminal connection apparatus.

SUMMARY OF THE INVENTION

The invention provides a battery terminal connection apparatus which includes a battery terminal and at least one connector pin therefor, wherein the battery terminal comprises:

(a) a body made of electrically conductive material;

(b) means enabling the body to be connected electrically to a battery post; and (c) at least two spaced apart sockets in the body; and wherein the or each connector pin comprises:

(d) a member made of electrically conductive material;

(e) means enabling the member to be connected electrically to the end of an electrically conductive cable; and (f) a spigot portion of the member which presents a plurality of prongs which are biased apart from one another, the spigot portion of the connector pin being receivable as an interference fit in a chosen socket of the terminal.

In one example, the connector pin member may comprise two prongs which are biased apart from one another, either by means of a resilient material acting between them or by virtue of their own inherent resilience.

In a preferred version of the invention, there is also provided an insulating housing for accommodating and concealing the body of the terminal, the housing including an aperture through its wall for each socket in the body, the or each pin being capable of passage through such aperture for insertion into the relevant socket.

For jump-starting applications, there may also be provided a high tension cable to one end of which a connector pin is connected electrically and to the other end of which another electrically conductive connector means is electrically connected, the connector means being connectable electrically to the battery post of another battery.

BRIEF DESCRIPTION OF THE DRAWINGS

One embodiment of the invention will now be described by way of example with reference to the accompanying drawings in which.

DESCRIPTION OF A PREFERRED EMBODIMENT

Figure 1:
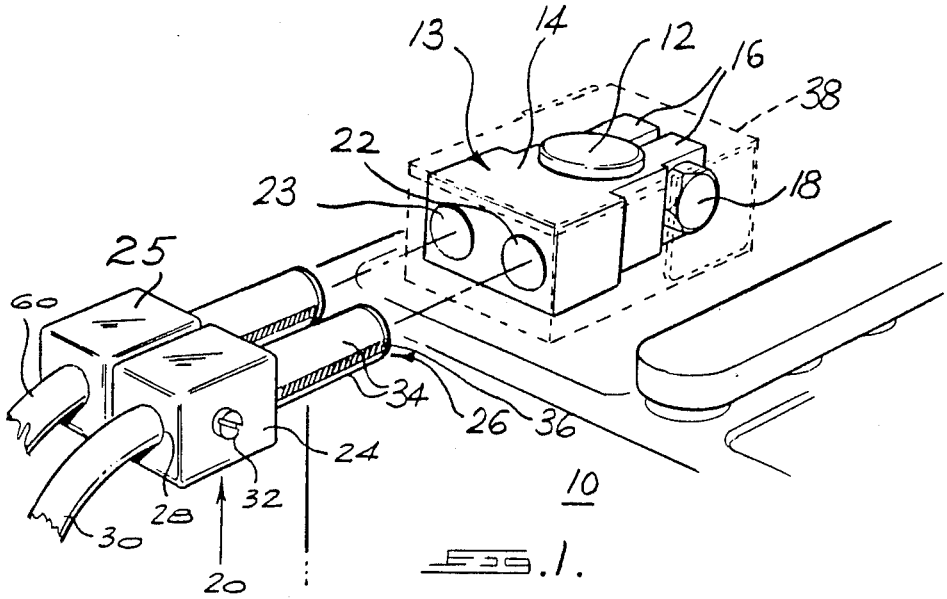
FIG. 1 shows a perspective, partially exploded view of an apparatus of the invention, the housing being shown in ghosted outline.

In FIG. 1, the negative post of a 12 volt DC motor vehicle battery 10 is indicated with the reference numeral 12. As is conventional the post has a frusto-conical shape and projects upwardly from the upper surface of the battery 10.

The invention provides a battery terminal 13 having an electrically conductive body 14 made of brass or other suitable rigid material. One side of the body is formed with spaced arms 16 having aligned bolt holes through which the shank of a clamping bolt 18 can be passed to clamp the arms about the battery post 12. It will be appreciated that this clamping system is identical to that found in most modern motor vehicles.

The body 14 has two round cylindrical, blind sockets 22 and 23 are formed in it side-by-side.

The invention also provides a connector pin 20 which consists of a member 24 of conductive material, typically brass or another suitable alloy, which has a spigot potion 26. The member 24 is formed with a blind socket 28 and with a threaded hole intersecting the socket 28. The bared end of a high-tension cable 30 is inserted into the socket 28 and is retained there by a grub screw 32 threaded into the hole so as to bear upon the bared end. It will be seen in FIG. 1 that the member 24 is encased in a plastics housing 25 from which the spigot portion 26 protrudes. The head of the screw 32 bears upon the housing 25.

The spigot portion 26 is composed of two prongs 34 which are part-circular in cross-section and which have flat opposing surfaces. A pad 36 of rubber or other resilient material is located between the prongs 34 and biases them apart from one another. In other embodiments, the prongs themselves may have sufficient resiliency to bias them apart from one another.

The dimensions of the spigot portion and the sockets 22 and 24 are such that the spigot portion can be forced into a socket so as to form an interference fit therein. The fact that the prongs are biased apart from one another means that reasonable force will be required to disconnect the connector pin from the terminal 13 and accordingly that a connector pin will not become dislodged merely by the movement of the motor vehicle.

Although not illustrated in the drawings, it should be apparent that a similar arrangement will be provided for the other, positive post of the battery.

One of the major advantages of the invention as thus far described is the fact that it enables battery cables to be connected rapidly to, and disconnected rapidly from, the battery.

It is conventional for one battery cable to be connected between the negative post of the battery and earth, i.e. the bodywork of the vehicle, and for another battery cable to be connected between the positive post and the ignition system of the vehicle.

Within the framework of this conventional battery cable pattern, the cable 30 will have its opposite end connected to earth (or the ignition system). If, for some reason, it is desired to isolate the battery from the electrical system of the vehicle, it is a simple matter to extract the connector pin from the socket in which it is located. This may, for instance, be necessary if an electrical fault develops in the vehicles's wiring and it is desired to isolate the battery to avoid the possibility of an electrical fire. Of course, the connector pins associated with both the positive and negative battery posts would be disconnected at the same time. It is evident that the invention enables the disconnection procedure to be carried out very rapidly and easily. To reconnect the battery, the connector pins at the ends of the earth and positive cables are merely pushed into their sockets on the terminals on the two battery posts again.

It is preferred that the sockets in the terminal 13 connected to one battery post have a larger internal diameter than the sockets of the terminal 13 connected to the other battery post. The spigot portions of the connector pins in this arrangement will then have different diameters so that it is impossible for the earth cable to be connected to the positive post and vice-versa.

Figure 3:
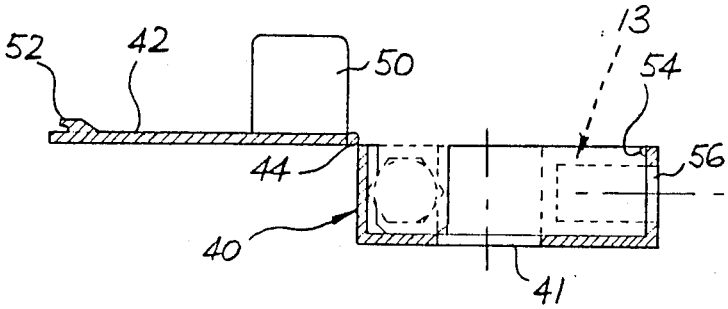
FIG. 3 shows a side view of the housing.
Figure 2:
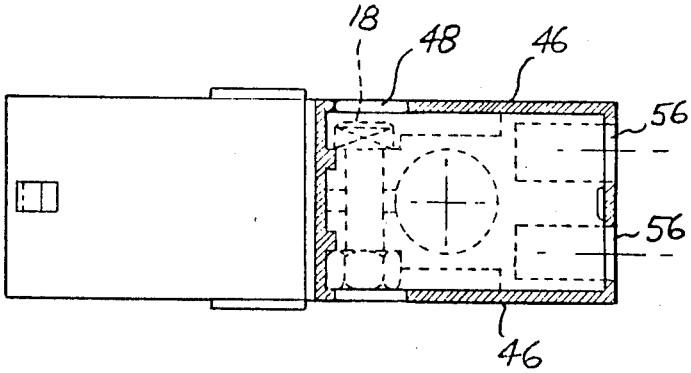
FIG. 2 shows a plan view on the housing and illustrates the positioning of the terminal therein.

Referring again to the drawings, FIG. 1 shows a moulded plastics housing 38 in ghosted outline, FIGS. 2 and 3 illustrate the housing in more detail. The housing is in the form of a rectangular box 40 having a lid 42 hinged to the upper wall of the box at 44. FIG. 2 shows how the terminal 13 is a snug fit in the box 40, the base of which has an aperture 41 through which the battery post 12 projects into the interior of the box. The sides 46 of the box alongside the arms 16 of the terminal are cut away at 48 to grant access to the head of the bolt 18 and to the associated nut, thereby enabling the terminal to be connected to, and disconnected from the post 12 when necessary.

The lid has two side portions 50 which are complementary in shape to the cut-away portions 48 so that when the lid is pivoted downwardly onto the box 40, the side portions 50 fit into the cut-away portions and complete the sides of the housing.

The lid also has a tongue 52 which makes a clip fit with a detent 54 when the lid is pivoted downwardly onto the box 40.

The end of the box 40 is formed with two side-by-side, round holes 56 which are located opposite the open mouths of the sockets 22 and 23 and through which the spigot portions of connector pins can be passed for insertion into the sockets.

In practice, the earth and positive battery cables will be connected to the two posts of the battery by insertion of their connector pins into the sockets 22 of the terminals 13 connected to the posts. This leaves the sockets 23 free for other uses.

One other such use contemplated by the invention involves the provision of independent, high tension jumper cables. Such cables will have appropriate connector pins at their one ends for insertion into the sockets 23. An example is indicated by the numeral 60 in FIG. 1. At their opposite ends, they may have identical connector pins for insertion into the sockets 23 of terminals fitted to the battery posts of a defective battery in another vehicle. Alternatively, they may have conventional crocodile or alligator clips for connection directly to the battery posts in the other vehicle. In either event, it will be possible with the use of such jumper cables to jump-start the other vehicle. It will be appreciated that the reverse situation also applies, namely that the vehicle in question can be jump-started from another vehicle as well. Note that the cut away portions 48 also enable a conventional crocodile clip to be applied to the bolt 18 when the lid 42 is hinged open.

Various other electrical accessories are also contemplated which can be connected up to the battery using the connector pins in the sockets 23. The vehicle battery can therefore be connected rapidly into a circuit to power a lamp, operate a tire pump, an electrical jack and so forth.

The provision of the housing 25 and the housing 38 is advantageous in two respects. Firstly, and most importantly, being of an insulating material, the housings will prevent possible arcing from injuring the hands of a person disconnecting the connector pins from the terminal. Secondly, the housing 38 will prevent possible shorting by preventing other conducting parts of the vehicle from coming into direct contact with the terminal 13. It has, for instance, happened that a dangerous short has arisen by contact of the vehicles bonnet with a battery terminal when the bonnet has been deformed in a collision or as a result of the vehicle overturning. Thirdly, the housing conceals the terminal in a neat fashion and prevents dirt from getting between the arms 16 and the battery post, thereby disturbing the integrity of the electrical connection between those components.

We claim:

1. A battery terminal connection apparatus comprising a battery terminal and at least one connector pin therefor, wherein the battery terminal comprises:

(a) a body made of electrically conductive material;

(b) means enabling the body to be connected electrically to a battery post; and (c) at least two spaced apart sockets in the body; and wherein said at least one connector pin comprises;

(d) a member made of electrically conductive material;

(e) means enabling the member to be connected electrically to the end of an electrically conductive cable; and (f) a spigot portion of the member which presents a plurality of prongs which are biased apart from one another, the spigot portion of the connector pin being receivable as an interference fit in a chosen socket of the terminal.

2. The apparatus of claim 1 in which the member includes two prongs which are biased apart from one another by means of a resilient element acting between them.

3. The apparatus of claim 1 in which the inherent resiliency of the prongs biases them apart from one another.

4. The apparatus of claim 1 including an insulating housing for accomodating and concealing the body of the terminal, the housing including an aperture through its wall for each socket in the body, the spigot portion of said at least one pin being capable of passage through such aperture for insertion into the relevant socket.

5. The apparatus of claim 1 including a high tension cable to one end of which a connector pin is connected electrically and to the other end of which another electrically conductive connector means is electrically connected, the connector means being connectable electrically to the battery post of another battery.

6. A set of battery terminal connection apparatuses which comprises two apparatuses according to claim 1, wherein the sockets in the body of one of the terminals are larger in cross-section than the sockets in the body of the other terminal.

* * * * *